US007390994B2

(12) United States Patent
Oh et al.

(10) Patent No.: US 7,390,994 B2
(45) Date of Patent: Jun. 24, 2008

(54) ELECTRIC COOKER HAVING A COMPOSITE HEAT SOURCE

(75) Inventors: Doo Yong Oh, Seoul (KR); Seung Jo Baek, Gwangmyeong-si (KR); Byeong Wook Park, Gwangmyeong-si (KR); Seung hee Ryu, Anyang-si (KR)

(73) Assignee: LG Electronics Inc., Seoul (KR)

( * ) Notice: Subject to any disclaimer, the term of this patent is extended or adjusted under 35 U.S.C. 154(b) by 62 days.

(21) Appl. No.: 11/456,979

(22) Filed: Jul. 12, 2006

(65) Prior Publication Data

US 2007/0131675 A1 Jun. 14, 2007

(30) Foreign Application Priority Data

Dec. 8, 2005 (KR) ..... 10-2005-0119320

(51) Int. Cl.
*H05B 6/12* (2006.01)

(52) U.S. Cl. ..... 219/601; 219/623; 219/624; 219/632; 219/443.1; 219/677; 99/451

(58) Field of Classification Search ..... 219/620–627, 219/601, 632, 672–677, 443.1, 450.1–452.13; 99/DIG. 14, 451
See application file for complete search history.

(56) References Cited

U.S. PATENT DOCUMENTS 2,515,579 A * 7/1950 Allen ..... 219/454.12
4,415,788 A * 11/1983 Field ..... 219/623
4,468,548 A * 8/1984 Yamaki ..... 219/601
4,899,027 A * 2/1990 Wong ..... 219/623
2004/0222217 A1* 11/2004 Yang ..... 219/620

FOREIGN PATENT DOCUMENTS

| | | |
|---|---|---|
| EP | 0951203 | 4/1999 |
| JP | 2004-171879 | 10/1999 |
| WO | 2004/060020 | 7/2004 |

OTHER PUBLICATIONS

U.S. Appl. No. 11/426,024, to Ryu et al., filed Jun. 23, 2006.
U.S. Appl. No. 11/536,722, to Kim et al., filed Sep. 29, 2006.
English language Abstract of JP 2004-171879.

* cited by examiner

*Primary Examiner*—Philip H Leung
(74) *Attorney, Agent, or Firm*—Greenblum & Bernstein, P.L.C.

(57) ABSTRACT

An electric cooker having a composite heat source includes an external case having an air inlet and an air outlet, a cooking plate mounted on an upper surface of the external case to be a top plate thereof, a heat generating unit mounted between the external case and the cooking plate, the heat generating unit including a work coil and an electric heater and arranged coaxially with the air inlet with respect to a center of the air inlet, a cooling unit coaxially arranged with respect to the center of the air inlet between the air inlet and the heat generating unit, the cooling unit cooling the heat generating unit, an air duct provided below the heat generating unit, and a reflector forming an outer cover of the electric heater.

12 Claims, 3 Drawing Sheets

ELECTRIC COOKER HAVING A COMPOSITE HEAT SOURCE

CROSS-REFERENCE TO RELATED APPLICATION

This application claims priority to application filed in the Korean Industrial Property Office on Dec. 8, 2005, and assigned serial No. 10-2005-0119320, the contents of which are incorporated herein by reference.

BACKGROUND

This invention relates to an electric cooker, and more particularly to an electric cooker having a composite heat source composed of an induction heating work coil and an electric heater, and still more particularly to an electric cooker improved in cooling efficiency by improvement of radiation structure.

The typical electric cooker is known as an environment-friendly product that can provide a clean and pleasant cooking environment because of being free from hazardous gas, soot, discharge of carbon monoxide and deficiency of oxygen.

The cooker is also widely used as an energy-efficient product because it takes a short time to reach a maximum thermal power by way of using a new material as heat source, and maintains a constant temperature using a temperature sensor.

An induction heating cooker which is one of the electric cookers is operated in such a manner that a magnetic field is generated by causing high-frequency current to flow through a work coil, and inducing the magnetic field into a cooking vessel, thereby generating eddy current to heat the cooking vessel. Conventionally, this type of induction heating cooker does not generate an air-polluting flame and have a high thermal efficiency, unlike a gas oven stove that heats a cooking vessel by way of oxidizing fuel. Therefore, the demand for this type of induction heating cooker is increasing.

In other words, the induction heating cooker conducts the cooking by using the heat generated by magnetic force applied to the cooking vessel. Therefore, the induction heating cooker is widely accepted as one of the excellent cookers as it generates heat for cooking by using the magnetic field, causing no air pollution and has a high energy usability of 80% or more thermal efficiency.

Meanwhile, the conventional electric cooker includes a cooking plate mounted on an external case, and a heat generating unit as a heat source provided at a bottom surface of the cooking plate. The heat generating unit may be an electric heater, or a typical flat pancake-like radially and spirally wound work coil, or may be a composite heat source using different types of heat sources including the electric heater and the work coil.

In the electric cooker disposed with a composite heat source, an internal temperature of the external case may suddenly increase due to driving heat generated by the electric heater. The rise of internal temperature can affect ambience of the work coil such that there is a need to install heat radiation means for appropriately maintaining the ambient temperature of the work coil having a limit in heat-resistance.

An external case of a typical electric cooker is disposed at an inner space thereof with an inverter (not shown) for driving a heat generating unit, a controller mounted with a driving circuit (not shown) and a cooling unit for cooling the heat generated from the heat generating unit and the controller.

The typical cooling unit of an electric cooker is disposed at one end of the external case thereof with a blowing fan for sucking outside air and blowing the air to the heat generating unit, where the introduced air is horizontally circulated in an inner space of the external case and discharged.

In the ventilation structure of the electric cooker thus explained, the outside air infused by the blowing fan disposed at one end of the external case is horizontally circulated for cooling the heat generating unit and the work coil and sequentially cools the ambient temperature of the work coil and the controller. In other words, the outside air introduced from outside by the blowing fan passes the electric heater to cool the work coil, and again passes the electric heater to cool the controller.

However, there is a disadvantage in the conventional ventilation structure thus explained in that it has a limit of cooling efficiency because the air that has passed the electric heater is used for cooling the work coil and the controller.

There is another disadvantage in that the introduced air is so configured as to horizontally go through a linear passage, making it difficult to effect a uniform cooling operation covering an entire area of the work coil and thereby decreasing the cooling efficiency.

There is still further disadvantage in that a fan of large capacity should be used to enhance the cooling efficiency of an electric cooker having a composite heat source, causing an enlarged size of the cooker and increased manufacturing cost.

SUMMARY

The present invention is disclosed to solve the afore-mentioned disadvantages of the conventional electric cooker and it is an object of the present invention to provide an electric cooker having a composite heat source configured to improve a ventilation structure for heat radiation of the electric cooker such that cooling efficiency, durability and reliability of the electric cooker can be enhanced.

It is another object of the present invention to provide an electric cooker having a composite heat source which is conducive to reducing the manufacturing cost and making a light, thin, small and compact product through configuration of a ventilation structure by which sufficient cooling efficiency can be obtained even with use of a small capacity of blowing fan.

In one general aspect, the electric cooker comprises: an external case having an air inlet and an air outlet; a cooking plate mounted on an upper surface of the external case; a heat generating unit mounted between the external case and the cooking plate for coaxial arrangement with the air inlet and for heating a cooking vessel mounted on the upper surface of the cooking plate; and a cooling unit coaxially arranged between the air inlet and the heat generating unit for cooling the heat generated by the heat generating unit via the air outlet.

The air inlet is formed as an opening on a floor of the external case and the air outlet is formed as an opening on a lateral surface of the external case.

The heat generating unit comprises: a work coil for inductively heating the cooking vessel disposed on the cooking plate; and an electric heater arranged about the work coil.

According to one embodiment of the present invention, the heat generating unit preferably comprises: a work coil for inductively heating the cooking vessel disposed on the cooking plate; an adiabatic plate disposed between the cooking plate and the work coil; an electric heater arranged about the work coil; and a reflector forming an outer cover of the electric heater.

The cooling unit comprises: a blowing fan disposed on a floor surface of the external case for being coaxially arranged between the air inlet and the heat generating unit; and an air duct so disposed as to form a passage between the blowing fan and the heat generating unit.

The air duct is a cylindrically structured body for guiding outside air introduced by the blowing fan to the heat generating unit, and is further disposed with an adiabatic duct.

DETAILED DESCRIPTION

Figure 1:
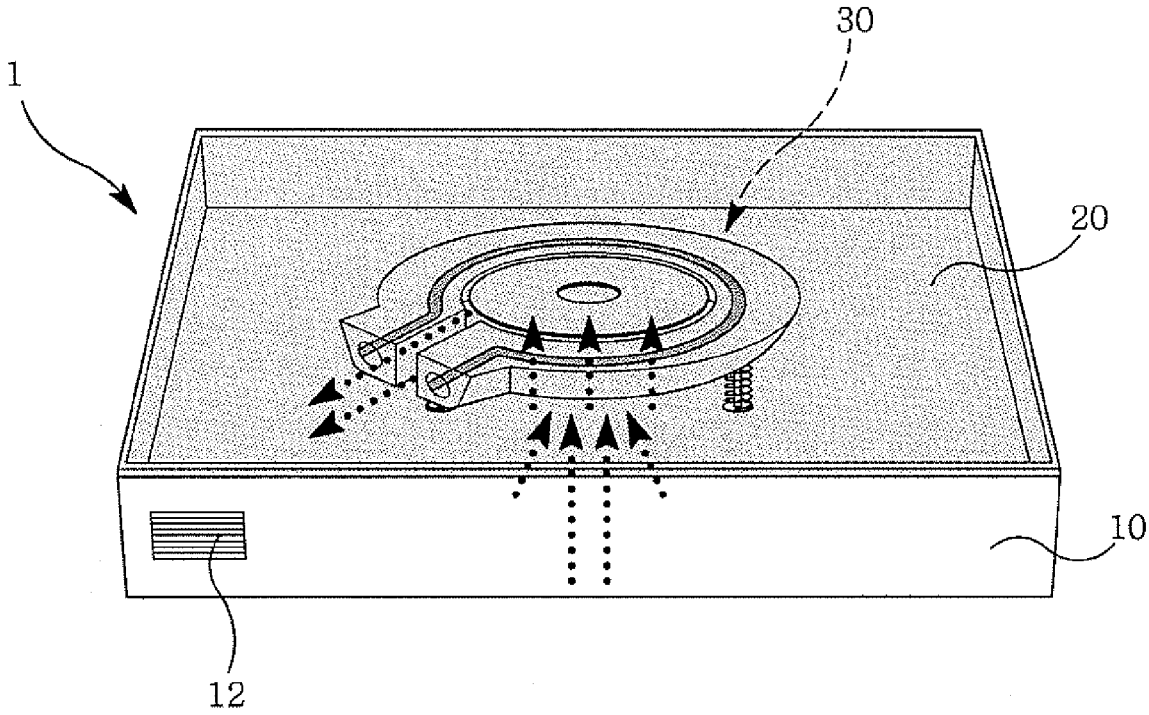
FIG. 1 is a schematic perspective view of an electric cooker according to the present invention.
Figure 2:
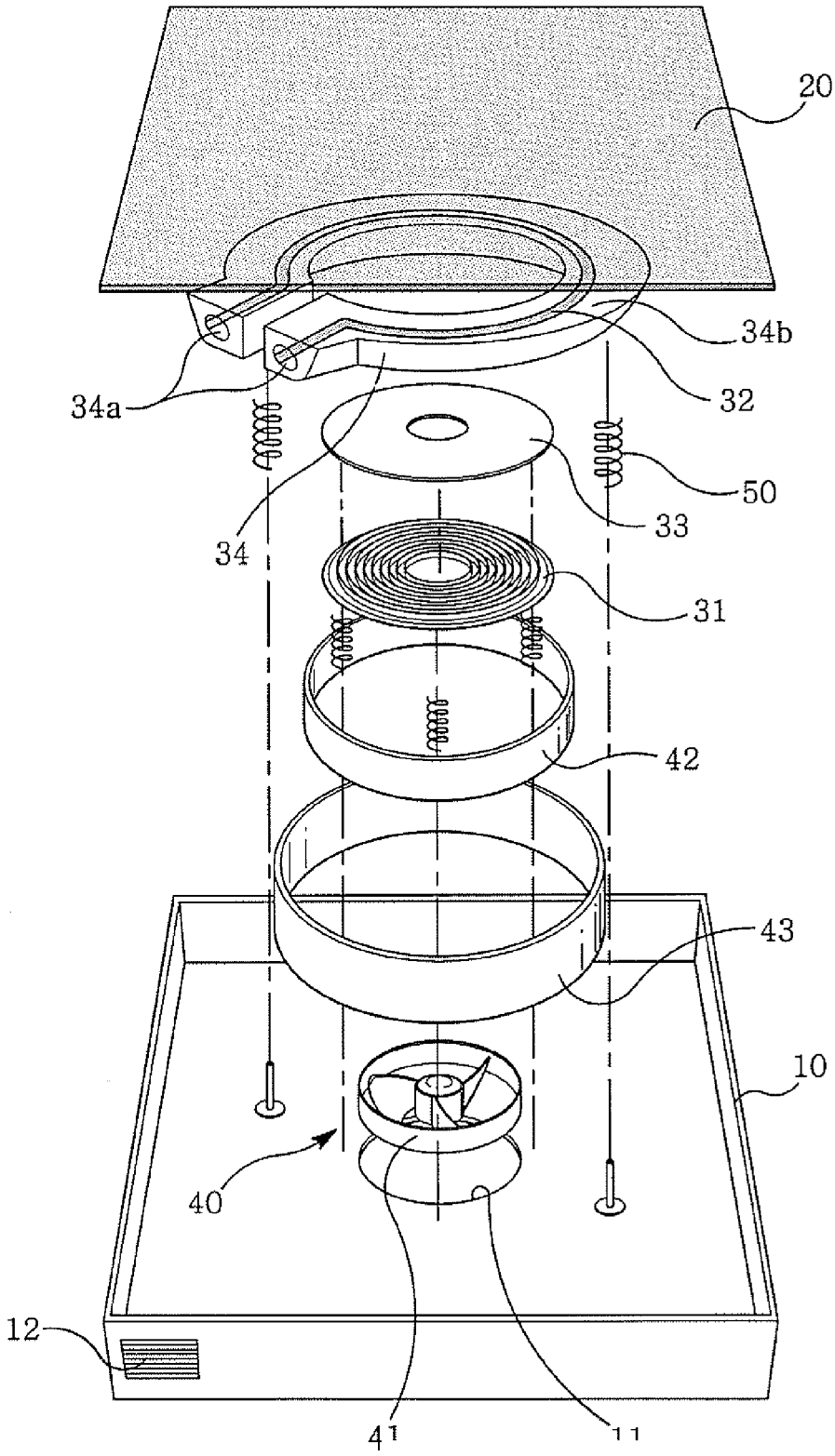
FIG. 2 is an exploded perspective view of the electric cooker of FIG. 1.
Figure 3:
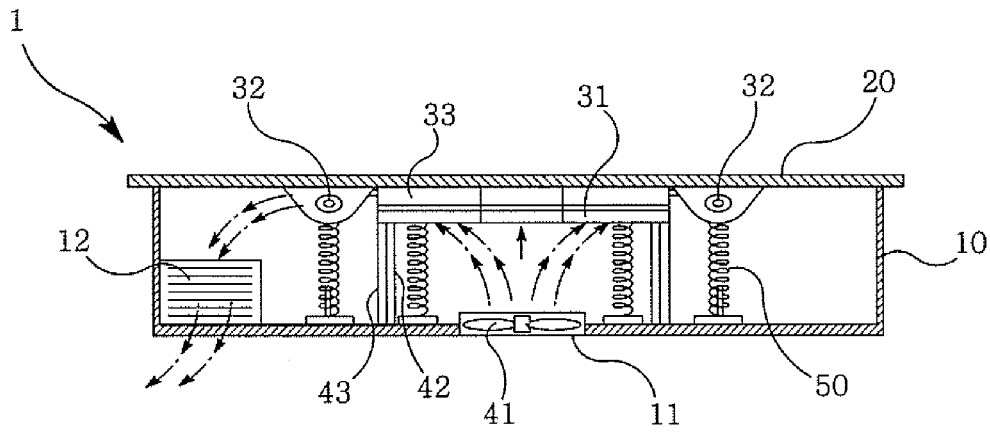
FIG. 3 is a schematic side view of the electric cooker of FIGS. 1 and 2.

Referring to FIGS. 1 to 3, an electric cooker 1 comprises; an external case 10 so disposed as to form a cooking plate 20 as a top plate; and a heat generating unit 30 and a cooling unit 40, each unit so disposed as to be coaxially arranged between the cooking plate 20 and the external case 10.

The external case 10 is disposed with an air inlet 11 and an air outlet 12 so that air can pass therethrough. The air inlet 11 is formed as an opening on an approximate center of the floor of the external case 10. The air outlet 12 is formed as an opening on a lateral surface of the external case 10.

The cooling unit 40 and the heat generating unit 30 in the electric cooker are sequentially arranged upwards of the air inlet 11. In other words, the heat generating unit 30 is coaxially arranged on the air inlet 11, and the cooling unit 40 is coaxially disposed between the air inlet 11 and the heat generating unit 30.

The heat generating unit 30 is a composite heat source composed of an induction-heating work coil 31 and an electric heater 32 for heating a cooking vessel (not shown) mounted on the cooking plate 20. Unexplained reference numeral 33 represents an adiabatic plate disposed for preventing heat generated by the electric heater 32 from being transmitted downwards, and 34 denotes a reflector.

The work coil 31 is disposed at a central bottom surface of the cooking plate 20 in the form of being wrapped up by the electric heater 32.

Preferably, the electric heater 32 and the work coil 31 are elastically mounted at the bottom surface of the cooking plate 20 in the form of being pushed upwards by a plurality of springs (50.).

The reflector 34 is disposed with a groove 34*b* for accommodating the electric heater 32, and is also formed at both ends thereof with openings for accommodating terminals 34*a* of the electric heater 32.

The electric heater 32 is mounted along the groove 34*b* of the reflector 34, and the terminals 34*a* of the electric heater 32 are arranged at the openings of the reflector 34.

The heat generated from the electric heater 32 is transmitted to the cooling plate 20 via the reflector 34 to heat the cooking vessel (not shown) and in addition, the work coil 31 may be selectively driven to heat the cooking vessel as a composite heat source.

The adiabatic plate 33 is disposed between the cooking plate 20 and the work coil 31 to form a disc shape The adiabatic plate 33 prevents the work coil 31 from being transmitted with heat of the electric heater 32. The adiabatic plate 33 further prevents the cooking plate 20 from excessively rising in temperature by the heat of the work coil 31.

The cooling unit 40 includes a blowing fan 41 and an air duct 42 for cooling the heat generated by the heat generating unit 30. The blowing fan 41 is supportively disposed on the floor of the external case 10 for being coaxially arranged upwards of the air inlet 11, and the blowing fan is mounted thereon with the heat generating unit 30.

The air duct 42 is a cylindrically structured body for forming a passage between the blowing fan 41 and the heat generating unit 30 and for guiding outside air introduced by the blowing fan 41 into the air inlet 11 to the heat generating unit 30.

According to one general aspect of the present invention, the air duct 42 may be further coaxially disposed thereabout with an adiabatic duct 43.

The adiabatic duct 43 guides in such a manner that the outside air having passed downstream of the air duct 42 is circulated along the passage formed between the work coil 31 and the electric heater 32 and the passage formed between the terminals 34*a* of the electric heater 32 to exit via the air outlet 12. Furthermore, the adiabatic duct 43 functions to prevent inside air of the external case 10 and the air introduced via the air duct 42 from being heat-exchanged.

Now, heat-radiating operation of the electric cooker thus configured according to the present invention will be described in detail with reference to the accompanying drawings.

If the electric cooker 1 is operated by a user, an electric power is applied to the heat generating unit 30 by a control signal of a controller (not shown) to start to heat the cooking vessel (not shown) mounted on the cooking plate 20. At this time, configuration of the electric cooker may be arranged in such a fashion that the power is applied to either an induction-heating work coil 131 or an electric heater 132, or the power is applied to both the work coil 131 and the heater 132 according to selection of operation mode by the user.

Meanwhile, the blowing fan 41 of the cooling unit 40 may be controlled in cooperation with the operation of the heat generating unit 30. Alternatively, the blowing fan 41 of the cooling unit 40 may be controllably driven independent of the operation of the heat generating unit 30 according to selective operation and need of the user.

Now, hereinafter, operation of the cooling unit 40, particularly, the operation for radiation of heat from the electric cooker will be described in detail.

The outside air infused into the air duct 42 via the air inlet 11 of the external case 10 cools the heat generated by the heat generating unit 30 with respect to rotational driving of the blowing fan 41, and is discharged to the outside via the air outlet 12 formed at the lateral surface of the external case 10. In the circulation structure thus described, the blowing fan 41 functions to conduct the circulating operation where the outside air is forcibly introduced into the air duct 42 via the air inlet 11, and is forcibly blown to heat generating unit 30 for discharge via the air outlet 12.

In other words, the heat generating unit 40 vertically induces the outside air sucked via the air inlet 11 by the operation of the blowing fan 41 and the air duct 42 and allows the air to first contact the work coil 31.

Successively, the air is induced to flow along the passage formed between the work coil 31 and the electric heater 32 and the passage formed between the terminals 34*a* of the electric heater 32 and to be discharged to the outside via the air outlet 12, thereby making it possible to concentratively cool the heat produced by the heat generating unit 30.

In the cooling process thus described, the adiabatic duct 43 prevents the air introduced from the outside from escaping to a space other than that formed by the terminals 34*a* of the electric heater 32.

In other words, the adiabatic duct 43 serves to guide the air raised by the blowing fan 41 toward the work coil 31 and the terminals 34*a* of the electric heater 32, and simultaneously to block the heat generated by the electric heater 32, thereby producing no effect on the work coil 31.

This is necessitated by the fear that the work coil 31, made of Litz wire to minimize power loss and thermal energy generation in which high frequency current flows, may lose an insulating performance of insulation coating and restrict operation temperature. So it is necessary in the first place to uniformly cool an entire surface of the work coil 31.

Figure 4:
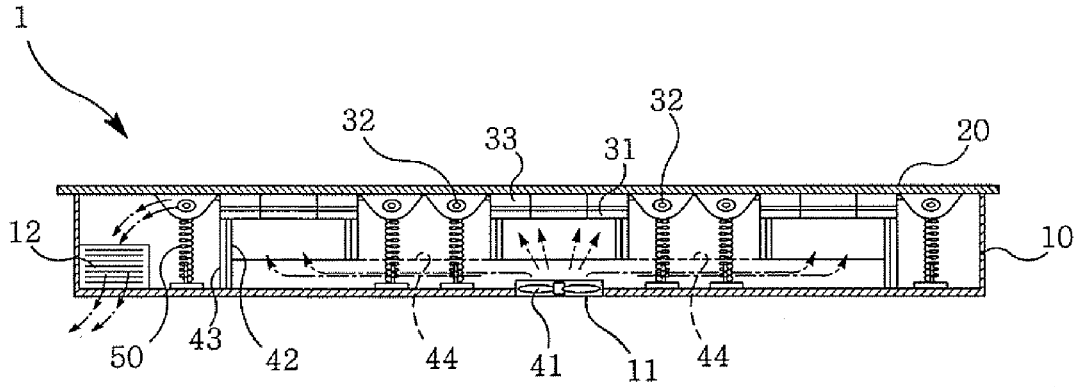
FIG. 4 is a schematic side view of an electric cooker disposed with a plurality of heat generating units according to another embodiment of the present invention.

Now, referring to FIG. 4 illustrating an electric cooker 1 where a plurality of heat generating units 30 are disposed, the electric cooker comprises: an external case 10 having an air inlet 11 and an air outlet 12; a cooking plate 20 mounted on an upper surface of the external case 10; a plurality of heat generating units mounted at a bottom surface of a cooking plate 20; and a cooling unit 40 connected to each heat generating unit 30 and for introducing outside air into the air inlet 11 to cool each heat generating unit 30 and to be discharged via the air outlet 12.

The cooling unit 40 includes a blowing fan 41 horizontally disposed on an upper surface of the air inlet 11 for inducing the outside air in the vertical direction of the external case 10, and a plurality of air ducts 42 vertically provided at the external case 10 for guiding the air sucked by the blowing fan 41 to be uniformly circulated to the bottom surface of each heat generating unit 30.

The cooling unit 40 further includes a plurality of connecting ducts 44 disposed underneath each heat generating unit 30 for connecting each air duct 42 50 that the outside air can be supplied. The outside air introduced via the blowing fan 41 and the air ducts 42 in this configuration passes each heat generating unit 30 via the connecting ducts 44. Consequently, according to the present invention, each heat generating unit 30 can be effectively cooled in an electric cooker formed with the plurality of heat generating units 30.

As apparent from the foregoing, the electric cooker according to the present invention has an advantage in that an optimum cooling efficiency can be embodied by a circulation structure where air sucked from outside can be directly transmitted to a heat generating unit.

Another advantage is that an effective heat radiation can be possible by a relatively small capacity of blowing fan to thereby enable to save the manufacturing cost. Still another advantage is that an effective utilization of space for parts arrangement can be enhanced by using a relatively small capacity of blowing fan, thereby enabling to manufacture an electric cooker in a thin, light, simple and compact manner. Still further advantage is that enhancement of radiation effect enables an electric cooker to be manufactured with a long durability and life.

The foregoing description of a preferred embodiment of the invention has been presented for purposes of illustration and description. It is not intended to be exhaustive or to limit the invention to the precise form disclosed. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. It is intended to cover in the appended claims all such changes and modifications that are within the scope of this invention.

What is claimed is:

1. An electric cooker having a composite heat source comprising:

an external case having an air inlet and an air outlet;

a cooking plate mounted on an upper surface of the external case to be a top plate thereof; a heat generating unit mounted between the external case and the cooking plate, the heat generating unit including a work coil and an electric heater and arranged coaxially with respect to a center of the air inlet;

a cooling unit arranged coaxially with respect to the center of the air inlet between the air inlet and the heat generating unit, the cooling unit cooling the heat generating unit;

an air duct provided below the heat generating unit; and a reflector forming an outer cover of the electric heater, wherein the reflector includes a plurality of openings in which terminals of the electric heater are accommodated and forms a second passage provided between the openings thereof, and the reflector and the air duct are configured to guide air introduced through the air inlet to a first passage formed between the electric heater and the work coil and then to the second passage.

2. The cooker as defined in claim 1, wherein the air inlet is provided on a floor of the external case and the air outlet is provided on a lateral surface of the external case.

3. The cooker as defined in claim 1, wherein the work coil heats a cooking vessel mounted on the cooking plate.

4. The cooker as defined in claim 1, wherein the work coil inductively heats the cooking vessel disposed on the cooking plate; and the electric heater is arranged about the work coil.

5. The cooker as defined in claim 1, wherein the heat generating unit further comprises an adiabatic plate disposed between the cooking plate and the work coil;

the work coil inductively heats the cooking vessel disposed on the cooking plate; and the electric heater is arranged about the work coil.

6. The cooker as defined in claim 1, wherein the cooling unit comprises:

a blowing fan disposed on a floor surface of the external case and coaxially arranged with respect to the center of the air inlet between the air inlet and the heat generating unit; and the air duct provides a third passage between the blowing fan and the heat generating unit.

7. The cooker as defined in claim 6, wherein the air duct is a cylindrically structured body to guide outside air introduced by the blowing fan to the heat generating unit.

8. The cooker as defined in claim 6, wherein an adiabatic duct is coaxially provided with respect to the center of the air duct.

9. The cooker as defined in claim 1, wherein the heat generating unit is equipped in plural numbers of at least two sets, the cooling unit is equipped in plural sets to correspond to each heat generating unit, and each cooling unit is interconnected by connecting ducts.

10. An electric cooker having a composite heat source comprising: an external case formed with an air inlet disposed on a floor surface and an air outlet formed at a lateral surface thereof;

a cooking plate disposed so as to form a top plate of the external case;

a blowing fan disposed on a floor surface of the external case and coaxially arranged with respect to a center of the air inlet upwards of the air inlet;

a plurality of heat generating units disposed between the external case and the cooking plate and coaxially arranged with respect to a center of the air inlet upwards of the blowing fan, each of the heat generating units including a work coil and an electric heater;

a plurality of cylindrical air ducts provided between the blowing fan and the heat generating unit to guide air sucked by the blowing fan to be blown to each heat generating unit; and a plurality of reflectors, each reflector forming an outer cover of the electric heater, wherein each reflector includes a plurality of openings in which terminals of the electric heater are accommodated and forms a second first passage provided between the openings thereof, and the reflectors and the air duct are configured to guide air introduced through the air inlet to a first passage formed between the electric heater and the work coil and then to the second passage.

11. The cooker as defined in claim 10, wherein an adiabatic duct is coaxially provided with respect to the center of each air duct.

12. The cooker as defined in claim 10, wherein the heat generating unit is equipped in plural numbers of at least two sets, and the blowing fan and the air duct are equipped in plural sets to correspond to each heat generating unit, and each air duct is inter-connected by connecting ducts.

* * * * *